US007299862B2

(12) United States Patent
Takada et al.

(10) Patent No.: US 7,299,862 B2
(45) Date of Patent: Nov. 27, 2007

(54) TOTAL HEAT EXCHANGING ELEMENT

(75) Inventors: Masaru Takada, Tokyo (JP); Hidemoto Arai, Tokyo (JP); Youichi Sugiyama, Tokyo (JP); Hisao Yokoya, Tokyo (JP); Kenzo Takahashi, Tokyo (JP); Junji Harada, Tokyo (JP); Masayuki Tsubaki, Tokyo (JP)

(73) Assignees: Mitsubishi Denki Kabushiki Kaisha, Chiyoda-Ku, Tokyo (JP); Mitsubishi Paper Mills Limited, Chiyoda-Ku, Tokyo (JP)

( * ) Notice: Subject to any disclaimer, the term of this patent is extended or adjusted under 35 U.S.C. 154(b) by 385 days.

(21) Appl. No.: 10/891,016

(22) Filed: Jul. 15, 2004

(65) Prior Publication Data

US 2005/0082045 A1 Apr. 21, 2005

(30) Foreign Application Priority Data

Oct. 15, 2003 (JP) ..... 2003-354635

(51) Int. Cl.
*F28F 13/18* (2006.01)

(52) U.S. Cl. ..... 165/133; 165/166

(58) Field of Classification Search ..... 165/133, 165/166

See application file for complete search history.

(56) References Cited

U.S. PATENT DOCUMENTS

| | | | | |
|---|---|---|---|---|
| 5,832,993 | A * | 11/1998 | Ohata et al. | 165/166 |
| 6,536,514 | B1 * | 3/2003 | Sugiyama et al. | 165/166 |
| 2003/0094269 | A1 * | 5/2003 | Arai et al. | 165/166 |
| 2003/0106680 | A1 * | 6/2003 | Serpico et al. | 165/166 |
| 2004/0140085 | A1 * | 7/2004 | Dobbs et al. | 165/166 |

FOREIGN PATENT DOCUMENTS

| | | | |
|---|---|---|---|
| JP | 54-44255 | | 4/1979 |
| JP | 55096896 | A * | 7/1980 |
| JP | 55140097 | A * | 11/1980 |
| JP | 56030595 | A * | 3/1981 |
| JP | 10-212691 | | 8/1998 |
| JP | 2001-241867 | | 9/2001 |

OTHER PUBLICATIONS

U.S. Appl. No. 10/189,556 filed Jul. 8, 2002, "Heat Exchanger and Heat Exchange Ventilator", pp. 1-33.

* cited by examiner

*Primary Examiner*—Allen J. Flanigan
(74) *Attorney, Agent, or Firm*—Buchanan Ingersoll & Rooney PC

(57) ABSTRACT

When latent heat is transferred between the two airflows flowing along the respective sides of each partition member, not only a layer of moisture absorbent but also a layer of flame retardant lies in the direction of transfer of the moisture. Thus, even if the moisture is absorbed by the layer of moisture absorbent, the layer of flame retardant resists the moisture transfer so that the amount of transfer of the moisture decreases in that part with a drop in the moisture permeability of the partition member. To solve the problem, there is provided a total heat exchanging element comprising partition members and spacing members having moisture permeable portions provided with moisture permeability and flame resisting portions provided with flame retardancy, the both portions not overlapping with each other within each single member. For example, the partition members have the moisture permeable portions provided with moisture permeability, and the spacing members have the moisture resisting portions provided with flame retardancy.

3 Claims, 2 Drawing Sheets

TOTAL HEAT EXCHANGING ELEMENT

BACKGROUND OF THE INVENTION

1. Field of the Invention

The present invention relates to a heat exchanging element of laminated structure for use in a heat exchanging apparatus for conducting heat exchange between two fluids in the field of air conditioning. In particular, the invention relates to a total heat exchanging element for exchanging both latent heat and sensible heat.

2. Description of the Related Art

A total heat exchanging element of laminated structure typically used in the field of air conditioning heretofore comprises basic component members each of which is formed by laminating a partition member of flat shape and a spacing member of corrugated section. Here, the basic component members are laminated and bonded so as to make the directions of corrugation in their spacing members have substantially right angles with each other. The spacing members of this total heat exchanging element form flow paths. Airflows of different states (typically, airflows of different temperatures and humidities) are passed through the flow paths which adjoin in the direction of lamination so that latent heat and sensible-heat are exchanged between the both fluids across the partition members.

The partition members lie between the two airflows, existing as the medium for latent- and sensible-heat exchange. The heat conductivity and moisture permeability of the partition members thus have a large impact on the efficiency of the latent- and sensible-heat exchange of the total heat exchanging element. The spacing members have the role of maintaining the partition members at certain spacings to secure the flow paths for the two airflows to pass through.

In a total heat exchanging element intended for air conditioning, it is particularly necessary to reduce the transfer of such gases as carbon dioxide ($CO_2$) between the two airflows. Both the partition members and the spacing members thus require a high gas barrier property aside from the foregoing capabilities.

Besides, the total heat exchanging element itself must have high flame retardancy in view of ensuring product safety. Various properties are thus required of the partition members and spacing members of the total heat exchanging element, and various types of partition members and spacing members have been used accordingly.

In one of conventional examples of the total heat exchanging element for exercising the foregoing capabilities, base paper is produced from slurry consisting chiefly of paper making fibers, mixed with a moisture absorbing/desorbing powder and a heat fusing substance. The base paper is impregnated with a flame retardant if necessary, and then provided with a moisture absorbing/desorbing coat on either or both sides to produce total heat exchanger paper. The resulting total heat exchanger paper is corrugated before laminated crosswise alternately (for example, see Japanese Patent Laid-Open Publication No. Hei 10-212691, pp. 3-4 and FIG. 1).

Another example is a total heat exchanger which is composed of flat liner sheets and corrugated sheets. The liner sheets are made of flame resisting paper formed by adding a flame retardant and a moisture absorbent to paper that consists chiefly of pulp. The corrugated sheets are made of a polypropylene film having no moisture absorbability. The corrugated sheets are joined with the liner-sheets interposed therebetween with their directions of corrugation orthogonal to each other alternately (for example, see Japanese Patent Laid-Open Publication No. 2001-241867, p. 2 and FIG. 1).

Still another example is a heat exchanger in which a plurality of flat partition plates are laminated with the intervention of corrugated spacer plates. Here, the corrugated spacer plates are made of base paper that is produced from a mixture of a ceramic fiber base material and a plant fiber base material, followed by impregnation of a flame retardant. The flat partition plates are also made of the same base paper impregnated with a flame retardant and a moisture absorbent (for example, see Japanese Patent Laid-Open Publication No. Sho 54-44255, pp. 1-2 and the drawings).

These conventional heat exchanging elements are characterized in that any of the partition members, i.e., the total heat exchanger paper, the liner sheets, and the partition plates contain a flame retardant and a moisture absorbent overlapping in lamination or in mixture.

Nevertheless, such conventional configurations with the overlapping flame retardant and moisture absorbent have the following problems.

1) Take the case of transferring latent heat, or equivalently, moisture between the two airflows flowing along the respective sides of each partition member. In the conventional configurations, not only a layer of moisture absorbent but also a layer of flame retardant lies in the direction of transfer of the moisture. Thus, even if the moisture is absorbed by the layer of moisture absorbent, the layer of flame retardant resists the moisture transfer so that the amount of the moisture transfer decreases in that part, with a drop in the moisture permeability of the partition member as a result.

2) Then, for the sake of still higher moisture permeability, it may be possible to increase the amount of the moisture absorbent. Nevertheless, the maximum total amount of chemicals capable of application or impregnation to a unit area of the base material of the partition member is limited. In the conventional configurations where the moisture absorbent and the flame retardant are both applied to the same portion of the partition member, an increase in the amount of the moisture absorbent thus decreases the amount of the flame retardant with a drop in flame retardancy. The same holds vice versa, adding up to another problem of a trade-off between the moisture absorbability and the flame retardancy.

3) Furthermore, since the moisture absorbent and the flame retardant are used in the same portion, deliberate selections of the two chemicals are required so as not to react with each other easily because of their contact. This means another problem which is a narrow choice of the moisture absorbent and the flame retardant. The narrow choice should be avoided as far as possible since it causes higher product cost.

As described in Japanese Patent Laid-Open Publication No. Sho 54-44255, moisture absorbability and flame retardancy may be provided simultaneously by impregnating the partition members with a flame retardant having moisture absorbability. This moisture absorbability, however, is not as high as that of a moisture absorbent, and it is therefore difficult to achieve exchange efficiency higher than with a moisture absorbent alone. In addition, the same problem as the foregoing problem 3) also occurs in that such a flame retardant has only a limited choice.

SUMMARY OF THE INVENTION

The present invention has been achieved to solve the foregoing problems. It is thus a first object of the present invention to prevent the effect of the moisture absorbent or other materials for providing moisture permeability from being hampered by the flame retardant or other materials for providing flame retardancy, thereby eliciting the effect of moisture permeation so that the total heat exchanging element improves in the efficiency of heat exchange.

A second object of the present invention is to allow the amounts of use of the moisture absorbent or other materials for providing moisture permeability and the flame retardant or other materials for providing flame retardancy to be set freely without restriction on each other, and allow the two to be selected irrespective of reactivity with each other so that the total heat exchanging element improves in the efficiency of heat exchange while achieving flame retardancy.

A total heat exchanging element according to the present invention comprises partition members and spacing members having moisture permeable portions provided with moisture permeability and flame resisting portions provided with flame retardancy, the two kinds of portions not overlapping with each other within each single member.

Since the moisture permeable portions provided with moisture permeability and the flame resisting portions provided with flame retardancy of the partition members and spacing members do not overlap each other within each single member, the effect of the moisture absorbent or the like for providing moisture permeability is not hampered by the overlap with the flame retardant or the like for providing flame retardancy, so that it is possible to elicit the effect of moisture permeation. As a result, it is possible to improve the effect of moisture permeation, so that the total heat exchanging element achieves both an improved efficiency of heat exchange and flame retardancy.

DETAILED DESCRIPTION OF THE PREFERRED EMBODIMENTS

First Embodiment

A total heat exchanging element according to a first embodiment of the present invention will be described in more detail with reference to the accompanying drawings.

Figure 1:
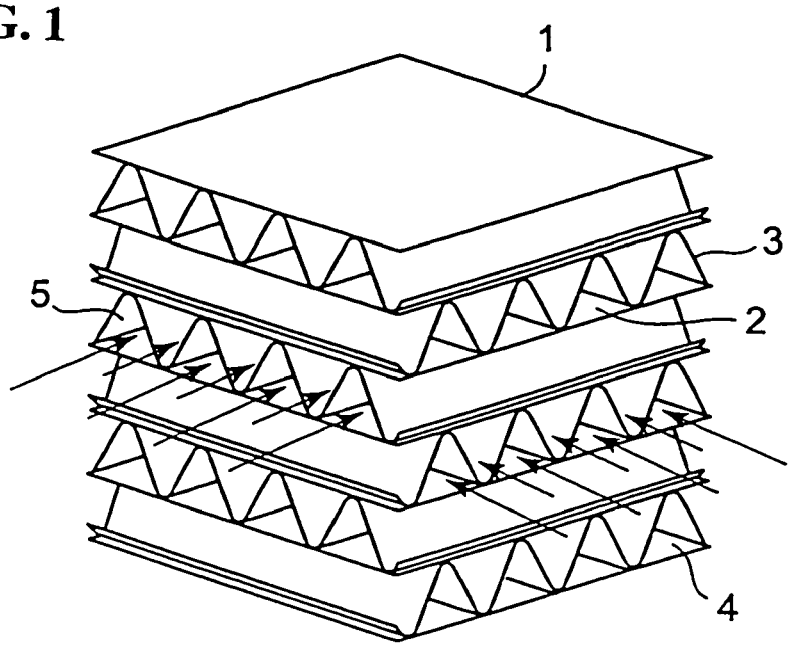
FIG. 1 is a perspective view showing a total heat exchanging element 1 according to a first embodiment of the present invention.
Figure 2:
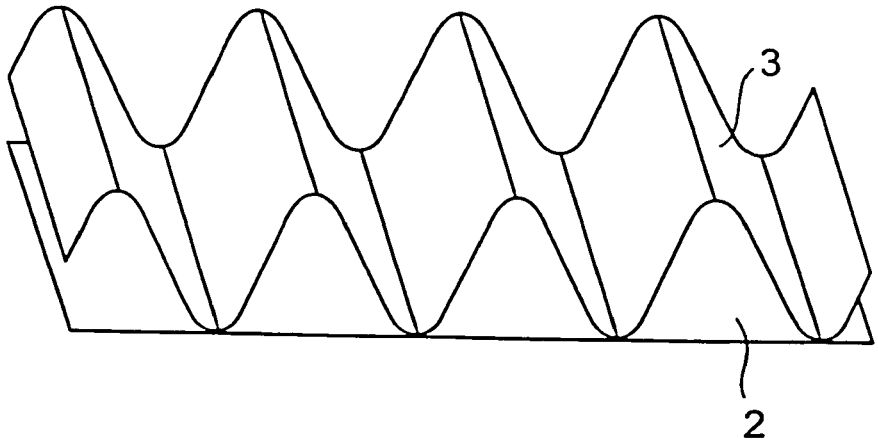
FIG. 2 is a perspective view showing a unit component member of the total heat exchanging element of FIG. 1.

FIG. 1 shows the total heat exchanging element 1 according to the first embodiment of the present invention. The total heat exchanging element 1 is composed of partition members 2 and spacing members 3 which are laminated alternately. The partition members 2 have a flat shape. The spacing members 3 have a corrugated section of serrate shape, sinusoidal shape, or the like. The spacing members 3 are formed so that their projections onto the planes of the partition members 2 coincide with the partition members 2. As shown in FIG. 2, a unit component member is fabricated by laminating a single partition member 2 and a single spacing member 3 so as to make contact at the convex portions of the corrugated shape, and fixing the same by such means as adhesive bonding. Such unit component members are laminated with the partition members 2 and the spacing members 3 in alternate layers so that the openings of the corrugated shapes of the spacing members 3 alternate by approximately 90° in direction (FIG. 1 shows an example where six unit component members are laminated into the total heat exchanging element). Consequently, as shown in FIG. 1, the total heat exchanging element 1 has flow paths 4 and 5 for the two types of airflow (shown by the arrows) intersecting each other in alternate layers. Two types of airflows having different states can pass through the two types of flow paths 4 and 5 to exchange latent heat and sensible heat between the airflows by the medium of the partition members 2.

Figure 3:
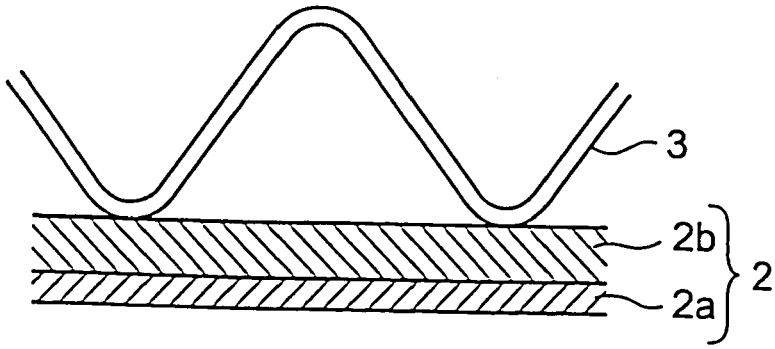
FIG. 3 is a sectional view of the unit component member of FIG. 2, taken along a direction perpendicular to the path thereof.

FIG. 3 is a sectional view of the unit component member of FIG. 2, taken perpendicularly to the direction of airflow through the flow path 4 or 5. For the sake of securing the moisture permeability, gas barrier property, and flame retardancy, the partition members 2 and the spacing members 3 of the total heat exchanging element 1 are given the following configuration.

Each of the partition members 2 is composed of a base material 2*a* and a moisture absorbent 2*b* applied to the base material 2*a*. The base material 2*a* is made of a cellulose-based material, such as nonporous pulp fibers (paper produced from beaten pulp), or a gas-impermeable microporous base material. The moisture absorbent 2*b* is an alkali metal salt such as lithium chloride and calcium chloride. The base material 2*a* is impregnated or coated with this moisture absorbent 2*b*. The spacing members 3 are also formed by impregnating pulp fibers with a guanidine-salt flame retardant such as guanidine chloride and guanidine sulfamate. A partition member 2 and a spacing member 3 are pasted to each other by an adhesive such as vinyl acetate adhesive, to form an unit component member as shown in FIG. 3.

The base material 2*a* of the partition member 2 itself is resistant to moisture transfer, and thus is desirably thinned as much as possible. The preferable thickness of the base material 2*a* is approximately 25 μm to 150 μm or so, however, since a reduction in the thickness causes an abrupt drop in material strength with deterioration in workability. In view of the gas barrier property, the base material 2*a* is made of nonporous film material. Water vapor cannot pass through nonporous material as if through porous material. Thus, the moisture transfer presumably takes the form that moisture is absorbed into the surface of the partition member 2 and permeates the same before it passes through the partition member 2 by moisture diffusion. According to this principle, the base material 2*a* of the partition member 2 is preferably made of hydrophilic material which has excellent moisture diffusibity, containing hydrophilic groups such as a hydroxyl group.

The base material of the spacing member 3 is so-called flame-resistant paper, made of ordinary pulp to which a guanidine-salt flame retardant is given at the stage of paper production. This paper is generally equivalent to flame retardancy grade 2 (JIS A1322, method of testing building thin material for flame retardancy). Otherwise, paper impregnated or coated with a flame retardant on either or both sides may also be used. The single-side coating, however, may be somewhat less effective when heated from the side opposite to the coated one. In consideration of its role of forming and maintaining the paths, the spacing member 3 is preferably as thick as possible for the sake of higher strength. When a thin partition member 2 is bonded to a thick spacing member 3 to form the unit component member as shown in FIG. 2, however, there might occur the phenomenon that the component member itself curves because of a difference between the size variations of the two members 2 and 3 resulting from moisture absorption after fabrication, and because of a difference between the strengths of the same. Such component members could cause a serious deterioration in workability when they are subsequently laminated into the element form as shown in FIG. 1. The thickness must therefore be determined with consideration given to those factors. In the present embodiment, a thickness of approximately 100 μm is employed.

In the total heat exchanging element 1 configured thus, the moisture absorbent and other chemicals including the flame retardant will not overlap each other on the partition members 2 which function as the medium for heat exchange. This provides the following two effects.

1) There is nothing but the base material 2*a* of the partition members 2 alone which resists the transfer of the moisture absorbed in the moisture absorbent. This elicits the effect of the moisture absorbent more than in conventional articles, with an improvement to the moisture permeability of the partition members 2 themselves.
2) The amount of use of the moisture absorbent can be determined freely independent of that of the flame retardant. Additional effects include an increase in the maximum possible amount of use of the moisture absorbent. These are combined into an ultimate effect that the total heat exchanging element 1 improves in the efficiency of latent-heat exchange. In addition, since the effect of the moisture absorbent can be elicited, it is possible to reduce the amount of use of the moisture absorbent while maintaining the same performance as heretofore. This means a cost reducing effect.
3) Furthermore, since the moisture absorbent and the flame retardant are not mixed with each other, it becomes possible to use chemicals that are not available heretofore due to reactivity therebetween. This leads to the effect of providing a wider choice of chemicals. Consequently, inexpensive effective chemicals can be selected from a wider range, and used with cost reduction.

To verify these effects, a test was conducted in which two samples were compared for the efficiency of latent-heat exchange and that of enthalpy exchange, with the same element size and the same conditions of circulating airflows. The two samples were the total heat exchanging element 1 of the present configuration and a total heat exchanging element of laminate type according to a conventional example. The conventional one had partition members made of a base material having flame retardancy, consisting of porous material and a flame retardant additive, coated with a moisture absorbent, as well as spacing members made of paper, a typical porous material. Table 1 shows the results.

TABLE 1

| Type of total heat exchanging element | Efficiency ratio of latent-heat exchange | Efficiency ratio of enthalpy exchange |
|---|---|---|
| Total heat exchanging element of conventional example | 1 | 1 |
| Total heat exchange element of present embodiment | 1.2 | 1.18 |

As can be seen, the present invention provides the effect that the total heat exchanging element 1 improves approximately 20% in the efficiency of latent-heat exchange and approximately 18% in the efficiency of enthalpy exchange at the same time. It is thus confirmed that the configuration of this total heat exchanging element 1 provides the effect of improving the exchange efficiencies, though the ratios may vary depending on the conditions etc.

The flame retardancy of the total heat exchanging element 1 is provided by the flame retardant which is included in the spacing members 3. As can be seen from FIG. 2 and others, the spacing members 3 have an area greater than that of the partition members 2. A greater amount of flame retardant can thus be applied as compared to the case where the partition members 2 alone are coated with the flame retardant.

To clarify the degree of flame retardancy of the total heat exchanging element 1, a flame test specified in UL-723, one of US standards, was conducted on three samples. The three samples were, namely, the total heat exchanging element 1, a total heat exchanging element given flame-retardant treatment to its partition members alone, and one given flame-retardant treatment to both partition members and spacing members thereof. Table 2 shows the results of the test.

TABLE 2

| Type of total heat exchanging element | Flame spread | Smoke developed |
|---|---|---|
| Conventional example 1 (Flame-retardant treatment to partition members and spacing members) | 0 | 0 |
| Conventional example 2 (Flame-retardant treatment to partition member alone) | 10 | 55 |
| (Total heat exchanging element of present embodiment (Flame-retardant treatment to spacing members alone) | 10 | 5 |

As can be seen, the total heat exchanging element 1 has flame retardancy considerably higher than that of the sample given flame-retardant treatment to its partition members alone, or rather has flame retardancy close to that of the sample given flame-retardant treatment to both the partition members and spacing members thereof. Applying flame-retardant treatment to the spacing members 3 alone can thus provide practically sufficient flame retardancy.

Consequently, the incorporation of the present configuration into a total heat exchanging element of laminate type can improve the efficiency of latent-heat exchange by virtue of such factors as elicitation of the effect of the moisture absorbent and an increase in the maximum possible amount of use thereof, while ensuring practically sufficient flame retardancy at the same time.

Incidentally, the total heat exchanging element 1 described above ensures the gas barrier property by using a nonporous material for the base material of the partition members 2. Nevertheless, porous film materials may also be used. In this case, a filler must be applied to fill the pores for the sake of ensuring the gas barrier property. The filler may be made of polyvinyl alcohol (PVA) or the like which has moisture permeability and the barrier property. This allows filling with minimum hindrance to the effect of the moisture absorbent. As a result, it is possible to provide almost the same effects as those of the total heat exchanging element 1 described above.

When the partition members 2 are made of such a porous material, nonporous films of polymeric material having high moisture absorbability comparable to that of a moisture absorbent, namely, members having a gas barrier property and moisture absorbability may be bonded instead of the filler. This also provides the same effects. In this case, in order to reduce the resistance against moisture transfer, nonwoven fabric or the like of high air permeability, having a minimum thickness and high porosity, should be selected as the base material. The reduced resistance can further increase the moisture absorbability of the entire partition members 2.

Note that the partition members 2 are made of the base material having the gas barrier property as described above, whereas there is a wide range of choices from nonporous to porous base materials for the spacing members 3.

In the total heat exchanging element 1 of the present embodiment, the partition members 2 are configured as moisture permeable portions provided with moisture permeability, and the spacing member 3 as flame resisting portions provided with flame retardancy. Since the moisture permeable portions and the flame resisting portions can be separated from each other, the effect of moisture permeation and the flame retardancy are obtained from the partition members 2 and the spacing members 3, respectively, so that the effect of the moisture absorbent or other materials for providing the moisture permeability is not affected hampered by the flame retardant or other materials for providing the flame retardancy.

In the total heat exchanging element 1 of the present embodiment, the partition members 2 are made of a nonporous base material or gas-impermeable microporous base material, and the base material is provided with the moisture absorbent. The spacing members 3 are made of a base material selected from among nonporous and porous ones, and the base material is provided with the flame retardant. The partition members 2 can thus provide moisture permeability and prevent the transfer of carbon dioxide and other gases between the two types of airflows by their nonporous base material or gas-impermeable microporous base material. In other words, the partition members 2 can ensure both the moisture permeability and the gas barrier property.

In the total heat exchanging element 1 of the present embodiment, the partition members 2 are made of a porous base material, and the base material is provided with the filler having a gas barrier property and the moisture absorbent or is provided with the members having a gas barrier property and moisture absorbability. The spacing members 3 are made of a base material selected from among nonporous and porous ones, and the base material is provided with the flame retardant. The partition members 2 can thus ensure the gas barrier property by means of the filler or the gas barrier members while ensuring moisture permeability by means of the porous base material. In particular, when the base material is provided with the members having a gas barrier property and moisture absorbability, it is possible to ensure the gas barrier property with a significant improvement in moisture permeability.

Second Embodiment

Figure 4:
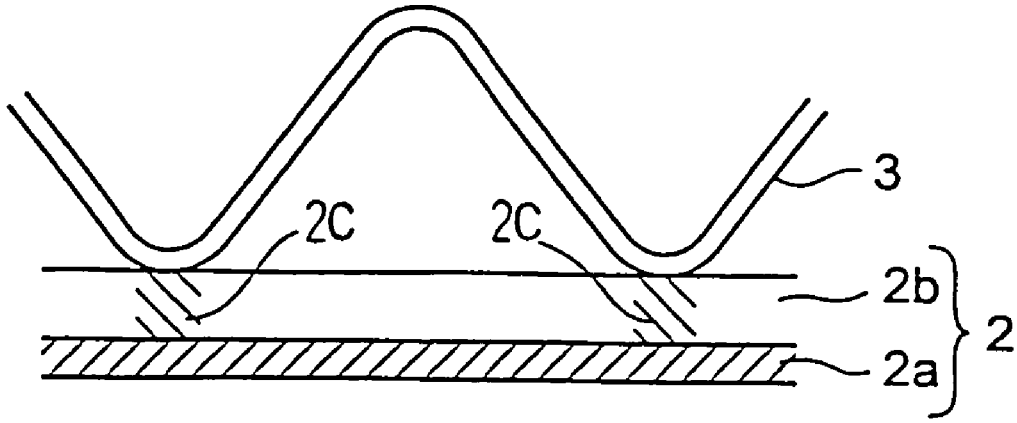
FIG. 4 is a sectional view of a unit component member of the total heat exchanging element according to a second embodiment of the present invention, taken along a direction perpendicular to the path thereof.

FIG. 4 is a sectional view showing the total heat exchanging element according to a second embodiment of the present invention. This sectional view is of the unit component member in FIG. 2, taken along a direction perpendicular to the airflow path formed by the spacing member.

In this total heat exchanging element 1, a flame retardant 2*c* (guanidine-salt flame retardant) is applied to specified areas of the base material 2*a* of the partition member 2, where the partition member 2 is in contact with the spacing member 3, and a moisture absorbent 2*b* to the other areas. The moisture absorbent 2*b* consists chiefly of an alkali metal salt such as lithium chloride and calcium chloride. The spacing member 3 is made of flame-retarded paper which is impregnated with a guanidine-salt flame retardant such as guanidine chloride and guanidine sulfamate. The partition member 2 is pasted to the same spacing member 3 as that of the first embodiment by an adhesive (such as vinyl acetate type) to form the configuration of FIG. 4.

In this total heat exchanging element 1, as in the total heat exchanging element 1 of the first embodiment, the moisture absorbent 2*b* does not overlap the flame retardant in the areas of the partition members 2 not in contact with the spacing members 3, where moisture transfer takes place actually. Consequently, it is possible to obtain the same effects including an improvement in the efficiency of latent-heat exchange as in the case of the total heat exchanging element 1 of the first embodiment. Besides, still higher flame retardancy is obtained since the amount and the area of application of the flame retardant are greater than in the foregoing case where the flame retardant is not applied to the base material 2*a* of the partition members 2.

In this configuration, some consideration must be given to such factors as the reactivity between the moisture absorbent 2*b* and the flame retardant 2*c* since the flame retardant 2*c* and the moisture absorbent 2*b* come into contact at the borders between their respective areas of application (2*b* and 2*c* in FIG. 4). Nevertheless, this configuration is far more suited to a total heat exchanging element 1 that requires particularly high flame retardancy, than those of other examples.

In the total heat exchanging element 1 of the present embodiment, the junction areas of the partition members 2 with the spacing members 3 are configured as flame resisting portions provided with flame retardancy, and the other areas as moisture permeable portions provided with moisture absorbability. The spacing members 3 are configured as flame resisting portions provided with flame retardancy. It is therefore possible to give flame retardancy to the junction areas which hardly contribute to moisture permeability, thereby enhancing flame retardancy without impairing moisture permeability.

A chief characteristic of the total heat exchanging elements 1 according to the first and second embodiments of the present invention, in terms of configuration, consists in that the moisture permeable portions provided with moisture absorbability and the flame resisting portions provided with flame retardancy, formed by providing the partition members 2 and the spacing members 3 with a moisture absorbent and a flame retardant, respectively, are prevented from overlapping each other within each individual partition member 2 and spacing member 3. It is this configuration that prevents the moisture permeable portions provided with moisture absorbability and the flame resisting portions provided with flame retardancy from interfering with each other to cause adverse effects on the moisture absorbability (moisture permeability) and/or the flame retardancy. Thus, selections of the moisture absorbent (moisture absorbability applying agent), the flame retardant (flame retardancy applying agent), and the like, and the method of providing these agents to the base materials of these members may be publicly known ones unless departing from the gist of the present invention.

As above, the total heat exchanging element of the present invention can be used effectively for heat exchanging apparatuses that conduct heat recovery in exchanging heat between room air and outdoor air for ventilation and other purposes in the field of air conditioning including air conditioners and ventilators.

What is claimed is:

1. A total heat exchanging element comprising:

partition members and spacing members laminated alternately, said partition members being spaced by said spacing members to form flow paths therebetween so as to allow two types of airflows to pass through adjoining ones of said flow paths, respectively, and exchange heat between said two types of airflows via said partition members, wherein said partition members and said spacing members have moisture permeable portions provided with moisture permeability and flame resisting portions provided with flame retardancy, said both portions not overlapping with each other within each single member, wherein:

said partition members have said flame resisting portions provided with flame retardancy at their junction areas in contact with said spacing members, and have said moisture permeable portions provided with moisture permeability at areas other than said junction areas; and said spacing members have only said flame resisting portions provided with flame retardancy.

2. A heat exchanging element comprising:

partition members and spacing members laminated alternately, said partition members being spaced by said spacing members to form flow paths between the partition members so as to allow separate airflows to pass through adjacent flow paths and to exchange heat between said separate airflows via said partition members, wherein said partition members have first portions provided with a flame retardant but not a moisture absorbent at the junction areas of the partition members in contact with said spacing members, and have second portions provided with a moisture absorbent but not a flame retardant at areas other than said junction areas; and said spacing members are provided with a flame retardant but not a moisture absorbent.

3. A heat exchanging element according to claim 2, wherein the partition members are flat and the spacing members are corrugated.

* * * * *